US006401323B1

(12) United States Patent
Roller et al.

(10) Patent No.: US 6,401,323 B1
(45) Date of Patent: Jun. 11, 2002

(54) METHOD OF PRODUCING WELDED CU AND CU ALLOY PIPES

(75) Inventors: Erling Roller, Essen; Peter Kalkenings, Aachen; Herbert Berendes, Mühlheim, all of (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 09/485,285

(22) PCT Filed: Jul. 1, 1998

(86) PCT No.: PCT/DE98/01898

§ 371 (c)(1),
(2), (4) Date: Feb. 7, 2000

(87) PCT Pub. No.: WO99/07491

PCT Pub. Date: Feb. 18, 1999

(30) Foreign Application Priority Data

Aug. 6, 1997 (DE) ..... 197 34 780

(51) Int. Cl.[7] ..... B23P 17/00
(52) U.S. Cl. ..... 29/527.7; 228/158; 228/173.4
(58) Field of Search ..... 29/527.7; 228/158, 228/173.1, 173.4

(56) References Cited

U.S. PATENT DOCUMENTS 3,858,785 A * 1/1975 McLain ..... 228/17

FOREIGN PATENT DOCUMENTS

GB 2055061 * 2/1981
JP 58168429 * 4/1983
JP 60102224 * 6/1985

* cited by examiner

*Primary Examiner*—P. W. Echols
(74) *Attorney, Agent, or Firm*—Cohen, Pontani, Lieberman & Pavane

(57) ABSTRACT

A process for producing welded pipes, from Cu and Cu alloys in a combined production line, having a casting installation for raw materials, a hot-rolling mill, a pipe-shaping and welding section and a drawing device for the welded pipe. The process has the sequence of the following process steps:

a. casting of a virtually endless initial strip,
b. hot-rolling of the cast initial strip at a rolling speed= casting speed×extension, to form an intermediate strip,
c. cooling of the intermediate strip to ≦100° C. to RT and descaling of the surface of the intermediate strip,
d. cold-rolling of the intermediate strip to form a strip,
e. coiling of the untrimmed strip to form coils of predetermined weights, the steps a to e being carried out as an in-line process followed, directly or after interim storage, by the following further operating steps,
f. unwinding and shaping of the strip to form a longitudinal seam pipe,
g. welding of the longitudinal seam to form a longitudinal seam pipe,
h. if necessary, external and internal deburring of the pipe
i. finishing to size, which is followed, immediately or after interim storage, by the following final operating step, and
j. drawing of the welded pipe in at least one drawing stage to form the finished pipe, if the welded pipe does not already constitute the finished pipe.

11 Claims, No Drawings

METHOD OF PRODUCING WELDED CU AND CU ALLOY PIPES

BACKGROUND OF THE INVENTION

1. Field of the Invention

The invention relates to a process for producing welded pipes from copper and copper alloys in a combined production line, comprising a casting installation for raw materials, a hot-rolling mill, a pipe-shaping and welding section and a drawing device for the welded pipe.

2. Discussion of the Prior Art

In the field of copper pipes and pipes made from copper alloys, a distinction is drawn between seamless pipes and welded pipes.

Seamless pipes are produced, for example, by the following process routes: continuous solid casting, extrusion, cold pilger rolling and drawing, although the cold pilger rolling may optionally be omitted. It is also known for the solid strand to be pierced in a cross-rolling piercing process, followed by cold pilger rolling and then drawing to its final dimensions. Processes in which a hollow strand is cast, which is then subjected to the drawing operation after the cold pilger rolling, should also be mentioned. All the processes described involve drawbacks; extrusion entails high production costs, and continuous hollow casting does not provide adequate quality of pipe. Moreover, pipes which are produced in seamless form have poor wall-thickness tolerances.

Welded pipes are generally produced from continuous-cast slabs which are roughed in hot-rolling mills for sheet metal, followed by cold-rolling, slitting and welding. Following the welding operation, the pipes are drawn using standard drawing processes. A drawback of the pipe-welding processes are the high costs of producing strip, which make the pipes uneconomical to produce.

The strip is produced using various processes. The process usually encompasses the continuous casting of slabs, hot-rolling of the slabs, milling of the surfaces, followed by cold-rolling, coiling of the cold-rolled strip and subsequent slitting into narrow strips which are fed to further processing stations. The advantage of the cold strip produced in this way resides in the high capacities of more than 100,000 t/a (metric tons per year) which can be achieved in combination with a good surface quality. The discontinuity of the process and the high production costs constitute drawbacks.

An alternative process involves the casting of thin slabs, which obviates the need for hot-rolling of broad strip. Then, in this case too, the surfaces of the strip are milled, before the strip is cold-rolled, coiled and slitted into narrow strips. This process can be carried out continuously, and mean capacities of less than 100,000 t/a can be achieved in combination with a good surface quality. This process also has the drawback of excessively high production costs.

A third process is known as the high reduction process. In this case, the strip is cast into graphite molds at a casting speed v=1 m/min, the surfaces are milled, the strip is cold-rolled with a high reduction per pass, is coiled and is slit into narrow strips. This process can be operated continuously, and the surface qualities which can be achieved are good. The low capacities of around, 10,000 t/a, together with the high production costs, constitute drawbacks of this process.

SUMMARY AND DESCRIPTION OF THE INVENTION

The object of the present invention is to provide an improved process for producing inexpensive pipes with a high dimensional accuracy and surface quality from copper and copper alloys, in which process rolled strip is processed into longitudinally welded pipes. The aim is that the process should be suitable for economically producing relatively small quantities up to relatively large quantities (between 10,000 and 100,000 t/a).

Pursuant to this object, and others which will become apparent hereafter one aspect of the present invention resides in a process having the following sequence of steps:

a. casting a virtually endless initial strip with dimensions in a range of width 45 to 200 mm, and thickness 10 to 70 mm, on a casting machine with a casting speed of up to 22 m/min;

b. hot-rolling the cast initial strip at a rolling speed= casting speed×extension to form an intermediate strip with dimensions in a range of width 45 to 200 mm and thickness 2.0 to 14 mm;

c. cooling the intermediate strip to ≦100° C. to RT (ambient or room temperature) and descaling of a surface of the intermediate strip;

d. cold-rolling the intermediate strip to form a strip with dimensions in a range of width 45 to 200 mm, and thickness 0.9 to 6.3 mm, e. coiling the strip to form coils of predetermined weights, the steps a to e being carried out as an in-line process followed by the following further operating steps;

f. unwinding and shaping the strip to form a longitudinal seam pipe;

g. welding the longitudinal seam immediately after trimming of edges, to form a welded longitudinal seam pipe;

h. if necessary, externally and internally deburring the pipe;

i. finishing to size; and j. drawing the welded pipe in at least one drawing stage to form a finished pipe, if the welded pipe does not already constitute the finished pipe.

According to other embodiments of the invention, the initial strip may be cast either on a strip-casting installation or on a rotary casting machine. Both casting processes are distinguished by high casting speeds and are therefore particularly suitable for economic production of the narrow strips in dimensions which are suitable to be directly processed further, rotary casting machines previously only having been used for the production of wire.

If, according to a further embodiments of the invention, the hot-rolling of the initial strip takes place at between 600° C. and 900° C., the process makes it possible to produce grain sizes in the material of 30–40 $\mu$m, which after cold-rolling offer better conditions for shaping the strips into welded pipes.

The fact that, according to the invention, the intermediate strip is trimmed directly in the welding machine eliminates the need for preparatory trimming, in addition to the need for slitting of the strips.

The hot-rolled initial strip can be descaled in-line using conventional descaling methods, for example by means of a chemical pickling method.

Advantageously, according to still another embodiment of the invention, a known high-frequency, TIG or laser welding method, comprising the steps of uncoiling, straightening and butt-welding of the intermediate strip, shaping, welding, internal and external deburring (if HF-welded), finishing to size, cutting to length, coiling and removal of the internal swarf, is used to weld the longitudinal seam pipe.

According to the invention, a known drawing process, involving the steps of uncoiling, block breakdown or continuous straight-line drawing, if appropriate, intermediate annealing (for the soft and semi-hard quality grades), finishing draw, and, if appropriate, soft annealing (for example for heat-exchanger pipes), may be used to draw the longitudinal seam pipe.

Alternatively, it is also conceivable to produce internally ribbed longitudinal seam pipes, again at economically viable cost and with good surface qualities, in a continuous or partially continuous process. This is accomplished by the following sequence of steps:

a. casting a virtually endless initial strip with dimensions in a range of width 45 to 200 mm, and thickness 10 to 70 mm, on a casting machine with a high casting speed of up to 22 m/min;

b. hot-rolling the cast initial strip at a rolling speed= casting speed×extension to form an intermediate strip with dimensions in a range of width 45 to 200 mm, and thickness 2.0 to 14 mm;

c. cooling the intermediate strip to ≦100° C. to RT (ambient or room temperature) and descaling a surface of the intermediate strip;

d. cold-rolling the intermediate strip to form a strip with dimensions in a range of width 45 to 200 mm, and thickness ≦0.9 mm;

e. coiling the strip to form coils of predetermined weights, the steps a to e being carried out as an in-line process followed, by the following further operating steps;

f. unwinding and slitting;

g. ribbing the strip;

h. shaping and welding and, if appropriate, finishing to size the ribbed strip, to form an internally ribbed longitudinal seam pipe in its finished dimension.

The process according to the invention is advantageous since it makes it economically possible, in a continuous process sequence, to produce welded copper pipes and pipes from copper alloys with a low to high capacity (10,000 to 100,000 t/a), and in the case of internally ribbed pipes even with a capacity of as little as 1000 t/a and less. The continuous process sequence using casting machines with very high casting speeds makes it possible to achieve the high capacity, on the one hand, on the other hand, without, however, having an adverse effect on the quality of the pipes. Despite the absence of the operation of milling the strip surface which is provided in the known prior art, the surface of the cast strip complies with the conditions imposed for precision strips for producing pipes. The grain size of 30 to 40 μm which is established during the hot-rolling enables more beneficial conditions to be provided when the strips are shaped into welded pipes than has hitherto been possible using soft (annealed) material. The process according to the invention is for the first time able to provide a practical process for producing welded nonferrous metal pipes which, due to its high capacity, its flexibility and its low costs, does not exhibit the drawbacks of the prior art which have been described.

The invention is not limited by the embodiments described above which are presented as examples only but can be modified in various ways within the scope of protection defined by the appended patent claims.

What is claimed is:

1. A process for producing welded pipes from Cu or Cu alloys in a combined production line, comprising a casting installation for raw materials, a hot-rolling mill, a pipe-shaping and welding section and a drawing device for the welded pipe, the process comprising a sequence of the following steps:

a. casting an initial strip with dimensions in a range of width 45 to 200 mm, and thickness 10 to 70 mm, on a casting machine with a casting speed of up to 22 m/min;

b. hot-rolling the cast initial strip to form an intermediate strip with dimensions in a range of width 45 to 200 mm and thickness 2.0 to 14 mm;

c. cooling the intermediate strip to ≦100° C. to ambient temperature and descaling of a surface of the intermediate strip;

d. cold-rolling the intermediate strip to form a strip with dimensions in a range of width 45 to 200 mm, and thickness 0.9 to 6.3 mm, e. coiling the strip to form coils of predetermined weights, the steps a to e being carried out as an in-line process followed by the following further operating steps;

f. unwinding and shaping the strip to form a longitudinal seam pipe;

g. welding the longitudinal seam immediately after trimming of edges, to form a welded longitudinal seam pipe;

h. if necessary, externally and internally deburring the pipe;

i. finishing to size; and j. drawing the welded pipe in at least one drawing stage to form a finished pipe, if the welded pipe does not already constitute the finished pipe.

2. A process for producing welded pipes from Cu or Cu alloys as defined in claim 1, wherein the step of casting the initial strip is carried out on a strip-casting installation.

3. A process for producing welded pipes from Cu or Cu alloys as defined in claim 1, wherein the step of casting the initial strip is carried out on a rotary casting machine.

4. A process for producing welded pipes from Cu or Cu alloys as defined in claim 1, wherein the hot-rolling step includes hot-rolling the initial strip at rolling temperatures of between 600 and 900° C., in order to achieve grain sizes of ≦40 μm.

5. A process for producing welded pipes from Cu or Cu alloys as defined in claim 1, wherein trimming of the intermediate strip takes place in a welding machine.

6. A process for producing welded pipes from Cu or Cu alloys as defined in claim 1, further including descaling the hot strip by means of chemical pickling.

7. A process for producing welded pipes from Cu or Cu alloys as defined in claim 1, wherein the welding step includes the steps of uncoiling, straightening and butt-welding the intermediate strip, shaping, welding, internal and external deburring, finishing to size, cutting to length, coiling and removing the internal weld seam.

8. A process for producing welded pipes from Cu or Cu alloys as defined in claim 1, wherein the drawing step includes uncoiling, block breakdown or continuous straight-line drawing, intermediate annealing if appropriate, finishing draw and, if appropriate, soft annealing.

9. A process for producing welded pipes from Cu or Cu alloys as defined in claim 1, further comprising the step of temporarily storing the coiled strip after step e).

10. A process for producing welded pipes from Cu or Cu alloys as defined in claim 1, and further comprising the step of temporarily storing the welded pipe after step i).

11. A process for producing internally ribbed welded pipes from Cu or Cu alloys in a combined production line, comprising a casting installation for raw materials, a hot-rolling mill, a pipe-shaping and welding section and a drawing device for the welded pipe, the process comprising a sequence of the following steps:

a. casting an initial strip with dimensions in a range of width 45 to 200 mm, and thickness 10 to 70 mm, on a casting machine with a high casting speed of up to 22 m/min;

b. hot-rolling the cast initial strip to form an intermediate strip with dimensions in a range of width 45 to 200 mm, and thickness 2.0 to 14 mm;

c. cooling the intermediate strip to ≦100° C. to ambient temperature and descaling a surface of the intermediate strip;

d. cold-rolling the intermediate strip to form a strip with dimensions in a range of width 45 to 200 mm, and thickness ≦0.9 mm;

e. coiling the strip to form coils of predetermined weights, the steps a to e being carried out as an in-line process followed, by the following further operating steps;

f. unwinding and slitting;

g. ribbing the strip;

h. shaping and welding and, if appropriate, finishing to size the ribbed strip, to form an internally ribbed longitudinal seam pipe in its finished dimension.

* * * * *